US009573188B2

(12) United States Patent
Schäfer et al.

(10) Patent No.: US 9,573,188 B2
(45) Date of Patent: Feb. 21, 2017

(54) METHOD FOR PRODUCING A FEEDER HAVING AN EXOTHERMIC FEEDER BODY, AND A FEEDER HAVING AN INSULATING EXTERNAL SHELL

(71) Applicant: GTP SCHÄFER GIESSTECHNISCHE PRODUKTE GMBH, Grevenbroich (DE)

(72) Inventors: Thomas Schäfer, Frechen (DE); Thomas Baginski, Leipzig (DE)

(73) Assignee: GTP SCHÄFER GIESSTECHNISCHE PRODUKTE GMBH, Grevenbroich (DE)

( * ) Notice: Subject to any disclaimer, the term of this patent is extended or adjusted under 35 U.S.C. 154(b) by 21 days.

(21) Appl. No.: 14/647,967

(22) PCT Filed: Nov. 29, 2013

(86) PCT No.: PCT/EP2013/075084

§ 371 (c)(1),
(2) Date: May 28, 2015

(87) PCT Pub. No.: WO2014/083155

PCT Pub. Date: Jun. 5, 2014

(65) Prior Publication Data

US 2015/0283602 A1 Oct. 8, 2015

(30) Foreign Application Priority Data

Nov. 29, 2012 (DE) ..... 10 2012 111 583

(51) Int. Cl.
*B22C 9/08* (2006.01)
*B22D 17/20* (2006.01)

(52) U.S. Cl.
CPC ..... *B22C 9/088* (2013.01); *B22D 17/2023* (2013.01)

(58) Field of Classification Search
CPC ..... B22D 17/2023; B22C 9/088
See application file for complete search history.

(56) References Cited

FOREIGN PATENT DOCUMENTS

| | | | |
|---|---|---|---|
| DE | 102007012117 | A1 | 9/2008 |
| FR | 2648373 | A1 | 12/1990 |
| WO | 0027560 | A1 | 5/2000 |

*Primary Examiner* — Kevin P Kerns
*Assistant Examiner* — Steven Ha
(74) *Attorney, Agent, or Firm* — Johnson, Marcou & Isaacs, LLC; Jennifer S. Stachniak

(57) ABSTRACT

The invention relates to a method for producing a feeder configured for use in a casting mold used for casting metals, wherein the feeder has a feeder body (14) enclosing a feeder cavity (15) and a through opening (19) in its base region (18) for connecting the feeder cavity (15) to the casting mold and the feeder body (14) consists of an exothermic material and is enclosed on its outer side at least in regions by an external shell (27) consisting of insulating refractory material, and wherein the feeder is provided with a feeder foot (20) arranged externally in its base region (18) and having an opening (21) flush with the through opening (19). The feeder is characterized in that the feeder body (14) produced in a first step in a conventional method from an exothermic material is used together with the feeder foot (20) associated with the base region (18) to form the external shell (27) into an injection mold (10) having a mold cavity (30) and feeder body and feeder foot are shot simultaneously with the insulating material, wherein the feeder body (14) including the feeder foot (20) is positioned in such a manner that the insulating material shot into the mold cavity (30) of the injection mold (10) fills in a gap (25) left between the feeder foot (20) and the base of the mold cavity (30) at least one part of the circumference of the feeder foot (20) and extending over at least a part of the height of the feeder foot (20), and the shot external shell (27) thereby extends at least partially under the feeder foot (20) with the exception of its (Continued)

opening (21) and is attached to the base region (18) of the feeder body (14) without the use of auxiliary means.

14 Claims, 3 Drawing Sheets

METHOD FOR PRODUCING A FEEDER HAVING AN EXOTHERMIC FEEDER BODY, AND A FEEDER HAVING AN INSULATING EXTERNAL SHELL

The instant application should be granted the priority date of Nov. 29, 2013, filing date of the corresponding International patent application PCT/EP2013/075084 and Nov. 29, 2012, the filing date of the German application DE 10 2012 111 583.4.

BACKGROUND OF THE INVENTION

The invention relates to a method for producing a feeder configured for use in a casting mold used for casting metals, wherein the feeder has a feeder body enclosing a feeder cavity and a through opening in its base region for connecting the feeder cavity to the casting mold and the feeder body consists of an exothermic material and is enclosed on its outer side at least in regions by an external shell consisting of insulating refractory material, and wherein the feeder is provided with a feeder foot arranged externally in its base region and having an opening flush with the through opening.

EP 2 489 449 A describes a feeder, whose feeder body is made from an exothermic, heat-producing material, which upon contact with the hot metal, whose temperature increases in the feeder cavity during the founding process, is combustible. The feeder body is surrounded externally at least partially by an external shell made from an insulating, fire-proof material. In this manner, it should be possible that the external shell made from the insulating material stores the heat existing by the liquid metal and the exothermic reaction with the feeder body made from the exothermic material, so that an increase of the modulus of such a feeder relative to a feeder made exclusively from an exothermic material is provided. It is therefore unchanged that the feeder body made from the exothermic material, based on the exothermic reaction, in addition to the flowing liquid metal, releases a defined amount of heat, which must be so great that if necessary, existing heat loss of the entire feeder system is compensated, despite the additional insulating outer shell. Based on this effect, the module of a purely exothermal feeder with a feeder having an insulating external shell is increased, that is, with a constant module required on casting technical grounds, the dimensions of the feeder can be reduced, also taking into consideration the insulating shell.

Regarding formation of a defined breaking edge for the feeder residue existing after completion of the casting process and cooking of the metal on the casting part and between the feeder body and the casting mold, a feeder foot in the form of a disc-shaped breaker core or in the form of a funnel-shaped metal disc is arranged. With the feeder shown in EP 2 489 449, the external shell either reaches only to the feeder foot or surrounds it only on its outer side. Thus, with the known feeder, the disadvantage can occur that with subsequent application of the breaker core or the metal disc on the feeder body, no central application of the feeder foot occurs, which leads to problems during formation of the feeder in the casting mold; for example, the breaker core or the metal plate during placement of the feeder on the forming mandrel of the casting mold, based on a deficient accuracy of fit, falls off or tears. In this case, the corresponding casting mold is not useable.

SUMMARY OF THE INVENTION

Because in EP 2 489 449 A, details for producing a corresponding feeder are not provided, the present invention is based on the object of providing a method for producing a feeder body made from an exothermic material and a feeder having an external shell made from an insulating, fire-proof material surrounding it and including a feeder foot associated with the feeder body.

The invention contemplates in its basic concept that the feeder body, produced in a first step in a typical method from exothermic material, is placed together with the feeder food associated with its base region to form the external shell in an injection mold having a mold cavity and the feeder body and the feeder foot are injected simultaneously with the insulating material, whereby the feeder body, excluding the feeder foot, is positioned in the mold cavity of the injection mold, such that the insulating material injected into the mold cavity of the injection mold exits between the feeder foot and the floor of the mold cavity at least onto a part of the circumference of the feeder foot and fills a gap extending over at least a part of the height of the feeder foot, and the injected external shell thereby at least partially engages under the feeder foot, with the exception of its opening, and without the use of auxiliary means, is held onto the base region of the feeder body.

One advantage that is connected with the present invention is that in an additional manufacturing step of mounting or attaching the feeder foot to the feeder body can be eliminated, because the fixing of the feeder foot to the feeder body takes place by means of the external shell that commonly surrounds both parts. In this manner, it is sufficient on the one hand if the external shell engages the feeder foot at least on a part of its circumference, and on the other hand, if the external shell, depending on the shape or design of the feeder foot, extends only over a part of its height, as long as the fixing of the feeder foot to the feeder body is maintained by the external shell.

An important further advantage of the invention is provided, in that the insulating layer formed additionally between the feeder foot and the mold cavity of the casting mold or the casting piece formed therein essentially contributes to increased efficiency of the feeder, because an energy or heat flow from the feeder system in the direction of the mold cavity is prevented. By means of the insulation that substantially surrounds the feeder foot, a heat dissipation in this regard, which in particular does not insignificantly fail with a feeder foot made from metal, is greatly reduced. Further, by the attachment of the feeder foot to the feeder body by means of the insulating layer engaging under the feeder foot, a process step with the manufacture of the feeder as well as the material in the form of the normally provided adhesive is spared. By eliminating the adhesive, as far as provided for attachment of the feeder foot to the feeder body, the additional advantage exists that also with casting process, the existence of gases by burning of the adhesive is prevented.

Thus, according to a further embodiment of the invention, it is advantageous that the feeder body and the feeder foot are positioned in the mold cavity of the injection mold, such that a gap extending over the entire circumference of the feeder foot is provided for receiving the insulating material.

In particular, with the embodiment of the method according to the present invention, it can be provided that the feeder foot and subsequently, the feeder body can be placed on a mandrel projecting from the base of the mold cavity and be positioned at a spacing to the base of the mold cavity that is determined according to the height of the gap.

In the frame of the present invention, the term "feeder foot" relates to all components or mold parts which connected the feeder body or the feeder cavity formed therein with the casting mold or with its mold cavity to be filled with liquid metal during the casting process, independently from whether it is a component to be mounted fixedly to the feeder body or a component moving relative to the feeder body under molding pressure acting during forming of the feeder in the casting mold.

According to a first embodiment of the invention, the feeder foot comprises a funnel-shaped metal plate having an opening in the region of the least diameter, whereby this shape of the feeder foot is generally known from EP 2 489 449. When using this type of feeder foot, it is provided that the funnel-shaped metal plate is inserted with a part of its vertical extension into a depression correspondingly formed in the base of the injection mold, so that the insulating material injected into the mold cavity of the injection mold penetrates into the predetermined gap and the metal plate surrounds the part of its height projecting over the depression; based on the design of the metal plate, which widens toward the feeder body, the metal plate is engaged from below by the external shell and fixed thereby to the base region of the feeder body.

With regard to an alternative embodiment, the feeder foot comprises a disc-shaped breaker core having the opening; according to the present invention, it is provided that the feeder body and the feeder foot are position in the mold cavity of the injection mold, such that the gap for receiving the insulating material is greater than the entire height of the breaker core forming the feeder foot. Based on the greater height of the gap, the external shell formed by the injection of the insulating material forms a projection that extends to under the disc-shaped breaker core and thereby fixes the breaker core to the base region of the feeder body.

Examples for embodiments of the feeder foot that are moveable relative to the feeder body are provided from EP 1 850 987 B1 or EP 1 184 104 A1. These embodiments relate to a tube-shaped body displaceable in the feeder cavity of the feeder body or a feeder base portion displaceable into the feeder cavity of the feeder body and made from an exothermic material.

Because with insertion of the feeder foot as well as the feeder body into the mold cavity of the injection mold, a centering of the above-named components must take place, according to an embodiment of the invention, it is provided that the feeder foot placed on the mandrel is centered by means of its opening engaging about the mandrel and the feeder body subsequently placed on the mandrel is centered on the feeder foot by means of a centering arrangement formed on its inner side, whereby according to an embodiment of the invention, the centering arrangement formed on the feeder body can be formed by a centering ring that surrounds the feeder foot on at least one part of its outer circumference and is arranged in the base region of the feeder body. Thus, only the feeder foot is centered on the mandrel, while the feeder body is fixed in a centered manner on the feeder foot and in this manner, is directly centered relative to the mandrel. Also other centering arrangements can be used for independent centering of the feeder body on the mandrel.

Alternatively, it can be provided that the feeder food is centered on the mandrel by means of its opening that engages over the mandrel and the feeder body is centered with its base region on the feeder foot by means of a collar formed on the upper edge of the feeder foot which extends over a part of the outer circumference of the feeder foot and surrounds the feeder body on its outer side.

When carrying out the method according to the invention, it can be provided that the feeder foot placed on the mandrel as well as the feeder body are fixed during injection of the insulating material by a sufficient hold-down device in the mold cavity of the injection mold, so that a defined form of the external shell is permitted. Insofar as then a recess in the cover region is formed by the hold-down device in the insulation shell, this facilities cutting off or boring through the produced feeder in connection to the forming on the upper case line of the casting mold. Typically, corresponding openings must be made, specifically with the molded feeders, in their cover regions, which serve to ventilate the casting mold during the casting process. The production takes place with smaller and intermediate mold casting sizes of the casting molds preferably by means of customary drilling machines, while with larger mold casting dimensions, automatic processing or automated systems are used. With the design of the feeder according to the present invention, the application of openings in the cover of the feeder body is facilitated by the recess formed in the insulation shell by using the hold down device, because on the one hand, the entire size of the cover region of the feeder is limited to the wall thickness of the feeder body and on the other hand, a guiding of the corresponding drilling tool is provided by the recess formed in the insulation shell.

During performance of the method, it is further important that the injection air released during injection of the insulating material is conducted in a dimensioned manner from the mold cavity and also, that likewise, that gas introduced for gasification of the manufactured injected feeder in the mold cavity can be conducted away via ventilation nozzles arranged in the base of the injection mold.

BRIEF DESCRIPTION OF THE DRAWINGS

The method according to the present invention will be described in greater detail below. In the drawings.

DETAILED DESCRIPTION OF THE PREFERRED EMBODIMENTS

Figure 1:
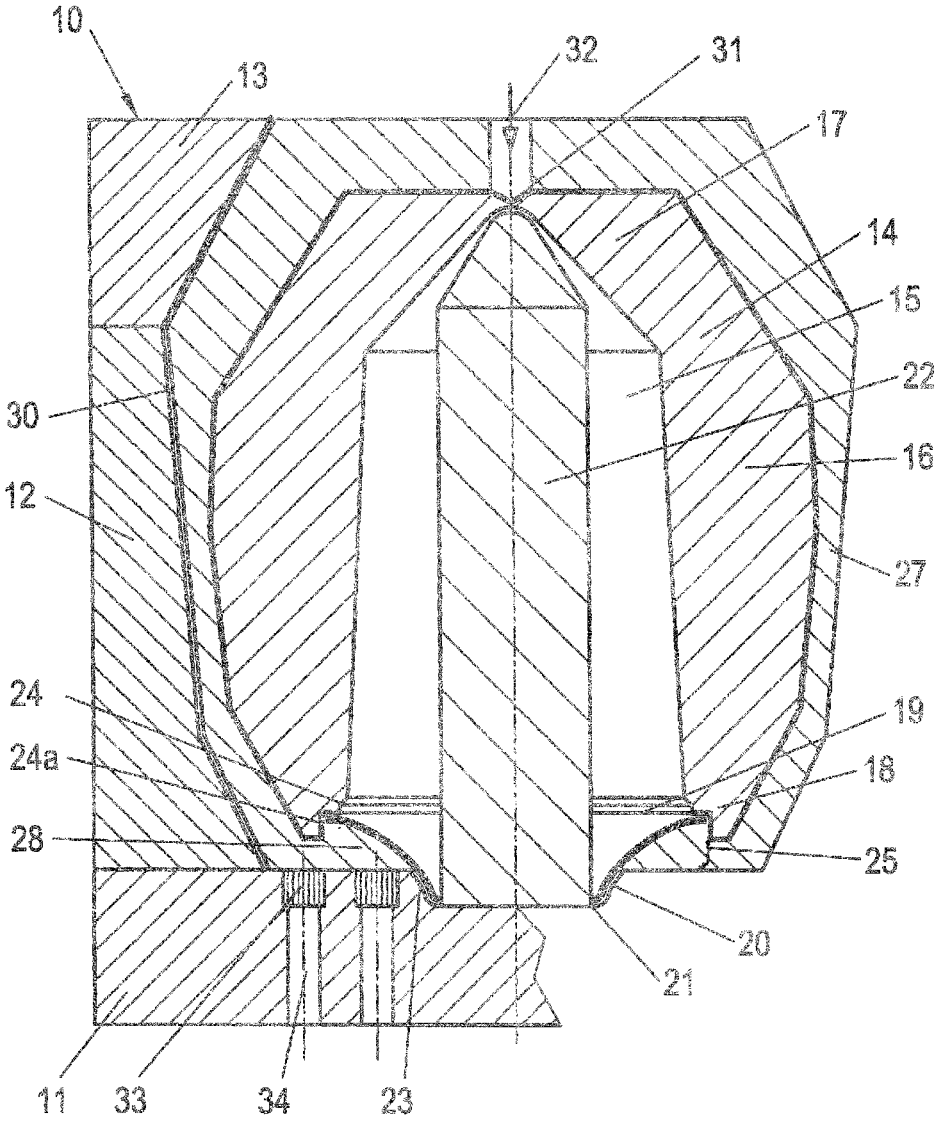
FIG. 1 is a partially illustrated injection mold with a completed, injected feeder arranged therein, the feeder having a feeder body with an outer shell surrounding it as well as a curved feeder foot, shown in a schematic representation.

In the left half of FIG. 1, a multi-part injection mold 10 for surrounding a feeder body 14 placed in the mold cavity 30 of the injection mold 10 with an insulating material is shown. This injection mold 10 comprises a base plate 11, a lower case 13 placed thereon, as well as an upper case 13. Arranged above the upper case is an injection head plate (not shown), which forms the upper termination of the mold cavity 30, and via which the insulating material is injected into the mold cavity 30.

The manufactured feeder visible in FIG. 1 comprises a feeder body 14 made from an exothermic material, which formed in its interior a feeder cavity 15 surrounded by a side wall 15 and a cover region 17. In the base region 18 of the feeder body 14, a passage 19 is arranged for connecting the feeder cavity 15 with the injection mold during normal use of the feeder. On the base region 18, a metal feeder food 20 is additionally arranged with a corresponding arranged opening 21, where by the feeder foot 20 comprises a funnel-shaped metal plate having the noted opening in the region of the least diameter.

In the frame of the inventive manufacturing process, the feeder foot 20 and the feeder body 14 are placed into the mold cavity 30 of the injection mold 10, whereby for fixing of the feeder foot 20 and the feeder body 14 during the injection process, both parts are placed on a mandrel 22 projecting from the base plate 11 of the injection mold 10. With the embodiment shown, the upper surface of the base plate 11 is formed with a depression 23 for partially receiving the funnel-shaped feeder foot 20, so that the feeder foot 20 projects only with a portion of its height over the base plate 11.

With regard to maintaining the centering of the feeder foot 20 and the feeder body 14 in the mold cavity 30 during the injection process, a centering of the feeder foot 20 takes place on the one hand by means of the mandrel 22 engaging through its opening 21 and further by adapting the shape of the depression 23 to that of the feeder foot 20. With regard to placement of the feeder body 14 on the mandrel 22, a centering ring 24 is placed into the through opening 19 in the base region 18 of the feeder body 14, which engages with a projection 24*a* of the feeder foot 20 on its outer circumference, the projection 24*a* projection at least over a part of its circumference, so that the feeder body 14 is centered on the feeder foot 20. An additional centering support of the feeder body 14 is provided on the mandrel 22, such that the mandrel 22 on its upper end has a cone-shaped contour, and also the associated upper region of the feeder cavity 15 of the feeder body 14 is formed, such that on the cover region 17 of the feeder body 14, an additional centering support is provided.

With regard to placing the feeder foot 20 and the feeder body 14 in the mold cavity 30 and holding them by the mandrel 22, a gap 25 is provided in the area of the region of the feeder foot 20 projecting over the depression 23 between the base plate 11 and the upper edge of the feeder foot 20 or the base region 18 of the feeder body 14. The gap 25 is filled by the insulating material during injection of the insulating material into the mold cavity 30, as is the intermediate space between the feeder body 14 and the inner wall of the mold cavity 30, so that an external shell 27 is collectively formed, which surrounds the feeder body 14 on the outside and comprises the insulating material. This external shell 27 forms a projection 28 engaging the region of the feeder foot 27 projecting over the depression 23, so that in this manner, also after removal of the completed feeder from the injection mold 10, the feeder foot 20 is fixed to the feeder body 14.

On the upper side of the cover region 17, the feeder body 14 has a return 31 for attachment of a hold-down device (not further shown), arranged on an injection head plate (also not shown), whereby with the embodiment represented, the engagement of the hold-down device according to the method is indicated by a channel 32 formed by the removal of the injection head plate with the hold-down device. Via the hold-down device, the feeder body 14 and the feeder foot 20 are fixed in the mold cavity 30 of the injection mold 10 during the injection process.

In particular, with regard to the formation of the projection 28 of the external shell 27, during the injection process, air still present in the mold cavity 30 before starting the injection process is discharged. In this connection, ventilation nozzles 33 with ventilation channels 34 leading away from the ventilation nozzles 33 are formed in the base plate of the injection mold 10, by means of which a dimensioned transport of the displaced injection air during the injection process occurs. Depending on the bonding system that is used in completing the injection process, a gasification of the injected feeder can take place and the ventilation nozzles 33 likewise also support a corresponding conveyance and dimensioning of the conducted gas flow.

Figure 2:
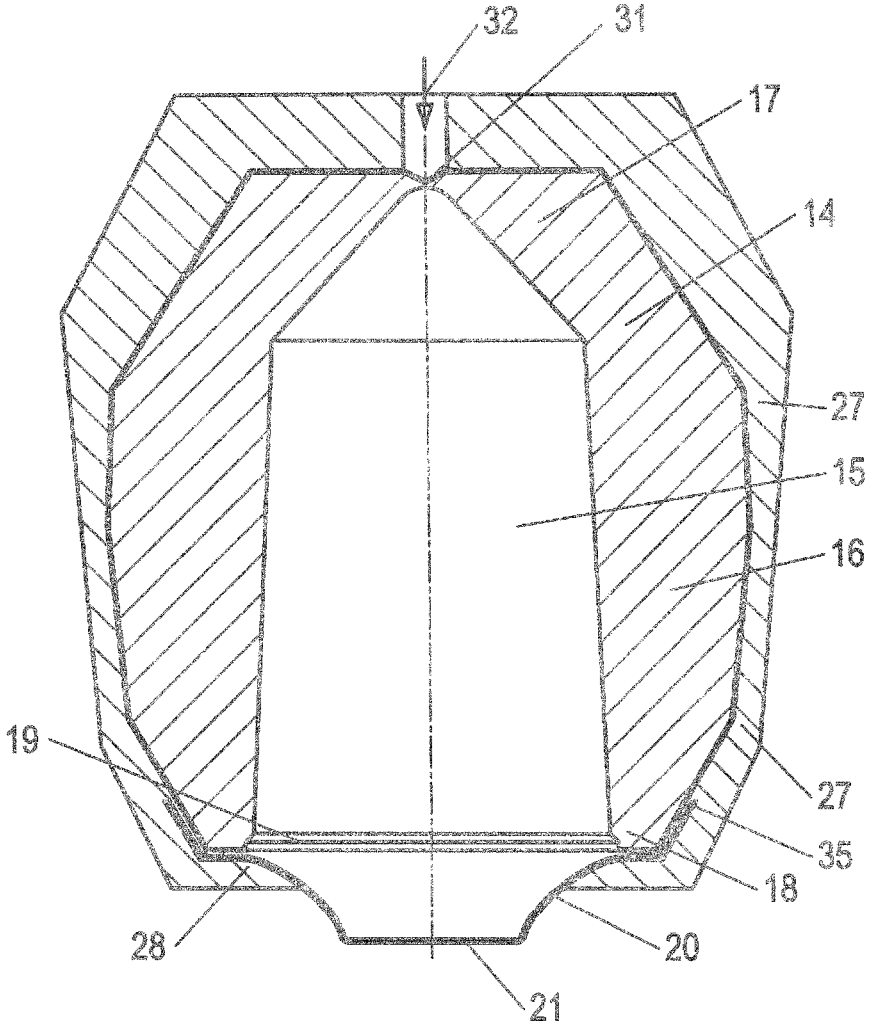
FIG. 2 is another embodiment of the completed, injected footer provided in FIG. 1.

The embodiment shown in FIG. 2 differs from the embodiment described above only in that the arrangement of the centering ring on the feeder body 14 is eliminated. In addition, the feeder foot 20 has a collar 35 projected from its upper edge, which is adapted to the outer design of the base region 18 of the feeder body 14, such that the feeder body 14 can be placed into the shell-shaped receiving structure of the feeder foot 20 and is thereby centered relative to the feeder foot 20. This collar 35 can be formed to run about the entire lower region of the feeder body 14; it is also sufficient if the collar 35 is only formed in segments.

Figure 3:
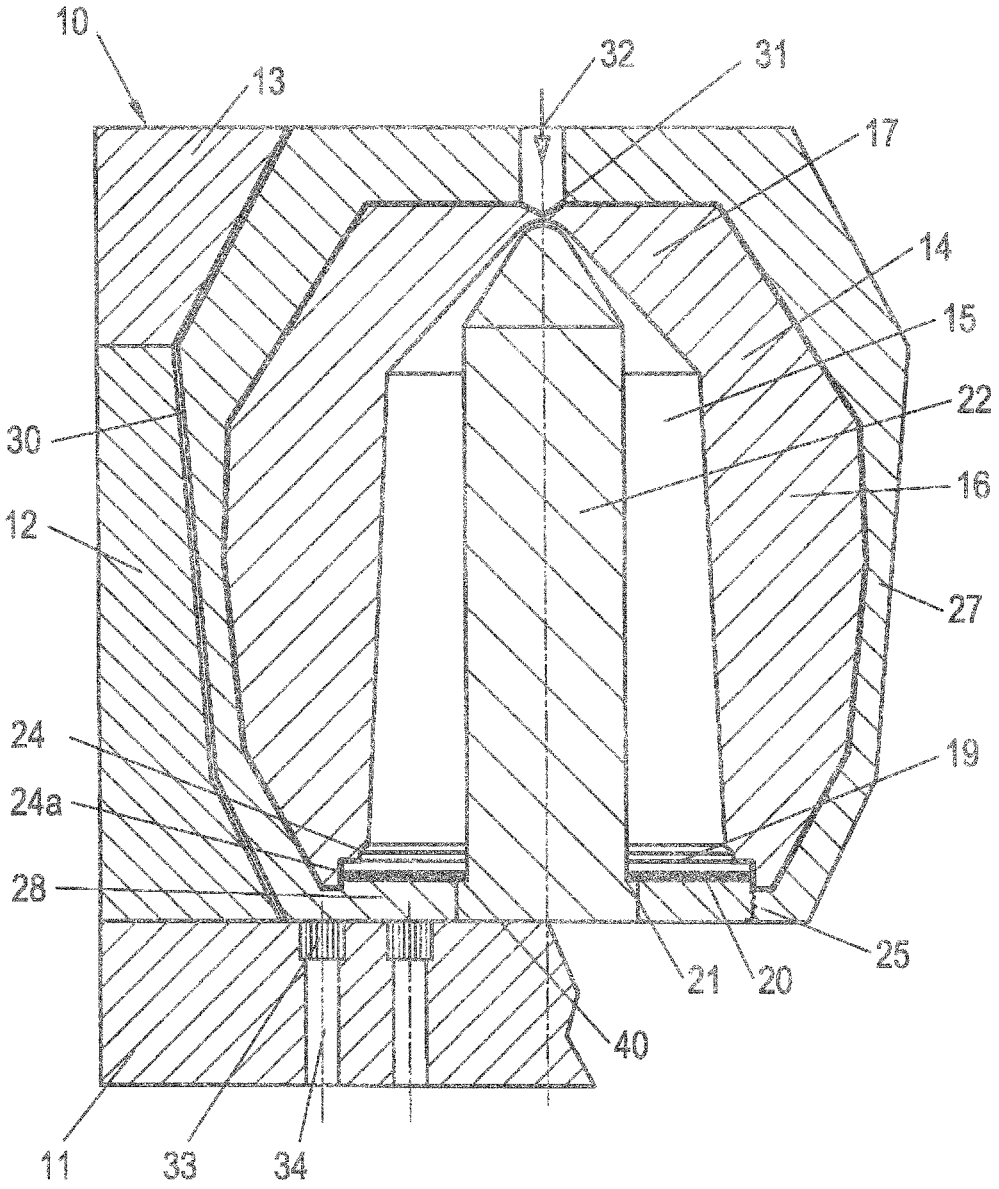
FIG. 3 is an injection mold in the representation according to FIG. 1 with a feeder food formed as a flat breaker core.

With the embodiment shown in FIG. 3, the feeder foot 20 also is formed as a disc-shaped breaker core in the form of a metal plate. In this case, during placement of the feeder foot and the feeder body, it must be ensured that the disc-shaped breaker core is fixed with a spacing to the upper surface of the base plate 11 of the injection mold 10, the spacing in turn forming a gap 25. This is realized by a projection 40 formed on the mandrel 22, which has a greater diameter than the opening formed in the disc-shaped breaker core. During placement of the disc-shaped breaker core into the injection mold, the breaker core with its central opening is guided onto the mandrel 22 and mounted on the projection 450 formed on the mandrel 22 and thereby also supports the subsequently placed feeder body 14. By fixing the disc-shaped breaker core on the mandrel 22, a sufficient spacing between the breaker core and the floor of the injection mold is provided, so that in this region, the part of the insulating external shell 27 engaging the break core forms. In such a case, during injection around the feeder body and the feeder foot with the insulating material, likewise a projection 28 of the external shell 27 formed that engages the feeder foot 20 in the form of the disc-shaped breaker core.

The features of the subject matter of this disclosure provided in the previous description, in the patent claims, the abstract and the drawings are important individually as well as in any combination for the realization of the invention its various embodiments.

The specification incorporates by reference the disclosures of International application PCT/EP2013/075084, filed Nov. 29, 2013 and DE 10 2012 111 583.4, filed Nov. 29, 2012.

The present invention is, of course, in no way restricted to the specific disclosure of the specification and drawings, but also encompasses any modifications within the scope of the appended claims.

The invention claimed is:

1. A method for producing a feeder configured for use in a casting mold used for casting metals, wherein the feeder has a feeder body enclosing a feeder cavity, wherein the feeder body has a base region with a through opening for connecting the feeder cavity to the casting mold, wherein the feeder body consists of an exothermic material and is enclosed at least partially on an outer side at least by an external shell consisting of insulating refractory material, and wherein the feeder is provided with a feeder foot arranged externally in the base region and having an opening flush with the through opening, wherein the feeder body produced in a first step from an exothermic material is placed together with the feeder foot associated with the base region into an injection mold having a mold cavity, wherein the feeder body and the feeder foot form the external shell that is placed in the mold cavity of the injection mold, wherein the feeder body and feeder foot are injected simultaneously with the insulating material, wherein the feeder body including the feeder foot is positioned in such a manner that the insulating material injected into the mold cavity of the injection mold fills in a gap left between the feeder foot and the base of the mold cavity at least one part of the circumference of the feeder foot and extending over at least a part of the height of the feeder foot, and the injected external shell thereby extends at least partially under the feeder foot with the exception of its opening and is attached to the base region of the feeder body without the use of auxiliary means.

2. The method according to claim 1, further comprising positioning the feeder body and the feeder foot in the mold cavity of the injection mold, such that a gap for receiving the insulated material is provided over the entire circumference of the feeder foot.

3. The method according to claim 2, further comprising placing the feeder foot and subsequently the feeder body on a mandrel projecting up from a base of the mold cavity of the injection mold and positioning the feeder foot and feeder body with a spacing relative to the base of the mold cavity that is determined based on a height of the gap.

4. The method according to claim 3, further comprising centering the feeder foot positioned on the mandrel on the feeder foot via the opening engaging over the mandrel, and centering the feeder body subsequently placed on the mandrel on the feeder foot via a centering arrangement formed on an inner side of the feeder body.

5. The method according to claim 4, wherein the centering arrangement formed on the feeder body is formed from a centering ring arranged in the base region of the feeder body and at least partially encompassing the feeder foot on its outer circumference.

6. The method according to claim 3, when feeder foot is centered on the mandrel via its opening engaged around the mandrel and the feeder body is centered with the base region on the feeder foot via a collar formed on an upper edge of the feeder foot, wherein said collar extends at least over a part of the outer circumference of the feeder foot and surrounds the feeder body on the outer side.

7. The method according to claim 3, wherein the feeder foot and the feeder body, respectively, placed on the mandrel are fixed during injection of the insulating material by a hold-down device extending into the mold cavity of the injection mold.

8. The method according to claim 1, wherein the feeder foot comprises a funnel-shaped metal plate having an opening formed in a region of the least diameter.

9. The method according to claim 8, wherein the funnel-shaped metal plate is inserted with a part of its vertical extension in a depression correspondingly formed in the base of the injection mold.

10. The method according to claim 8, wherein the feeder foot comprises a disc-shaped breaker core having the opening.

11. The method according to claim 10, wherein the feeder body (14) and the feeder foot (20) are positioned in the mold cavity of the injection mold, such that the gap for receiving the insulating material is greater than an entire height of the breaker core forming the feeder foot.

12. The method according to claim 1, wherein the feeder foot comprises a tube-shaped body forming the opening and is displaceable into the feeder cavity of the feeder body.

13. The method according to claim 1, wherein the feeder foot comprises an exothermic material and a feeder base displaceable into the feeder cavity of the feeder body.

14. The method according to claim 1, wherein injection air displaced from the mold cavity during injection of the insulating material and a gas conducted into the mold cavity for gasification of the produced feeder are conducted via ventilation nozzles arranged in the base of the injection mold.

* * * * *